US005172866A

United States Patent [19]

Ward

[11] Patent Number: 5,172,866

[45] Date of Patent: Dec. 22, 1992

[54] MULTI-FUNCTION SHOWER HEAD

[75] Inventor: Irving Ward, Hacienda Heights, Calif.

[73] Assignee: Interbath, Inc., City of Indust., Calif.

[21] Appl. No.: 883,881

[22] Filed: May 12, 1992

Related U.S. Application Data

[63] Continuation of Ser. No. 565,499, Aug. 10, 1990.

[51] Int. Cl.[5] ..... B05B 1/16

[52] U.S. Cl. ..... 239/446; 239/449

[58] Field of Search ..... 251/251, 257; 239/446–449, 552, 562, 586, 1, 11; 137/625.18, 625.25, 625.67

[56] References Cited

U.S. PATENT DOCUMENTS

| | | | |
|---|---|---|---|
| 2,726,120 | 12/1955 | Bletcher et al. | 239/449 |
| 3,363,842 | 1/1968 | Burns | 239/448 X |
| 3,672,648 | 6/1972 | Price | 263/21 |
| 3,682,392 | 8/1972 | Kint | 239/447 X |
| 3,722,798 | 3/1973 | Bletcher et al. | 239/447 X |
| 3,801,019 | 4/1974 | Trenary et al. | 239/383 |
| 4,131,233 | 12/1978 | Koenig | 239/447 X |
| 4,190,207 | 2/1980 | Fienhold et al. | 239/381 |
| 4,219,160 | 8/1980 | Allred | 239/447 |
| 4,254,914 | 3/1981 | Shames et al. | 239/447 X |

*Primary Examiner*—Andres Kashnikow
*Assistant Examiner*—Kevin P. Weldon
*Attorney, Agent, or Firm*—Graham & James

[57] ABSTRACT

A shower head that provides a series of spray effects. The shower head includes an inlet port to establish fluid communication with a source of water and at least two outlet ports to direct a spray with various effects to the user. A pushrod disposed in fluid communication between the inlet port and the outlet ports selectively opens the outlet ports to allow the user to continuously select any combination of spray effects, which may include a continuous stream or a pulsating jet. The pushrod is actuated by a rotating cam ring operated by the user. The cam moves the pushrod transversely across the inlet port and, under control of of the user, directs water from the inlet port to the outlet ports. The cam ring maintains the pushrod in the selected orientation.

10 Claims, 4 Drawing Sheets

FIG. 5
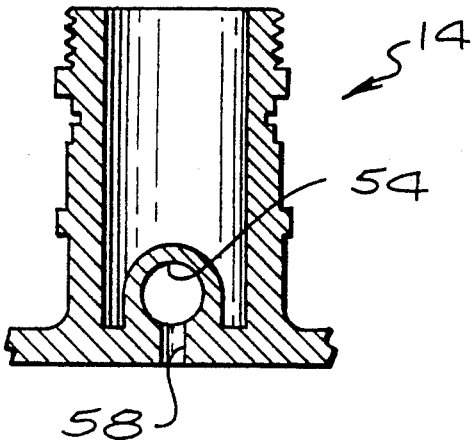
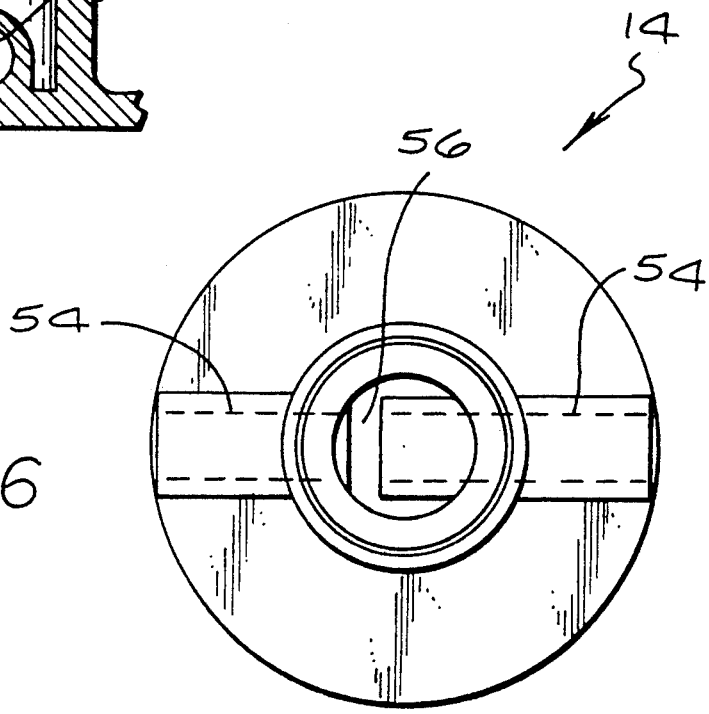
FIG. 6
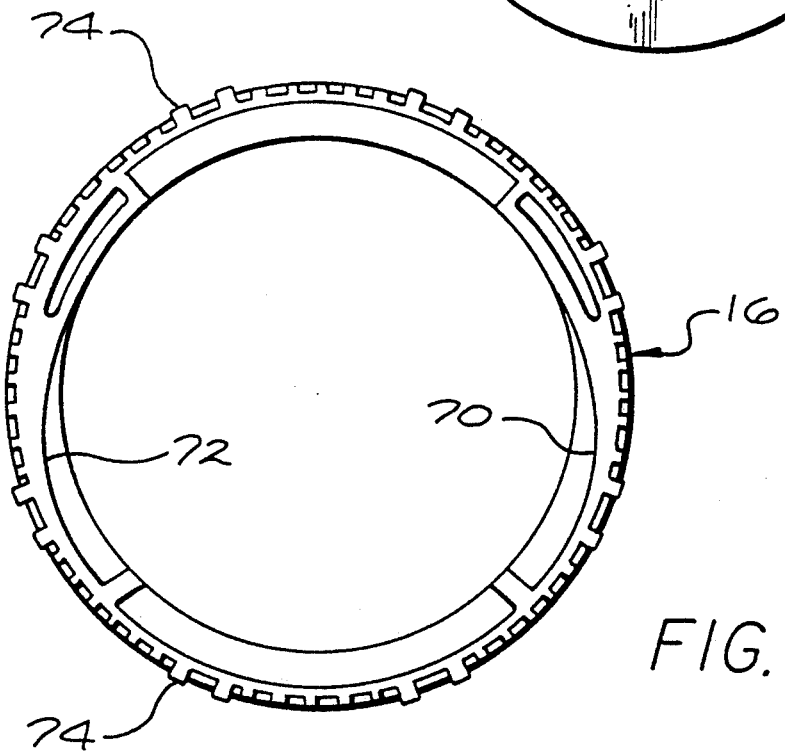
FIG. 7

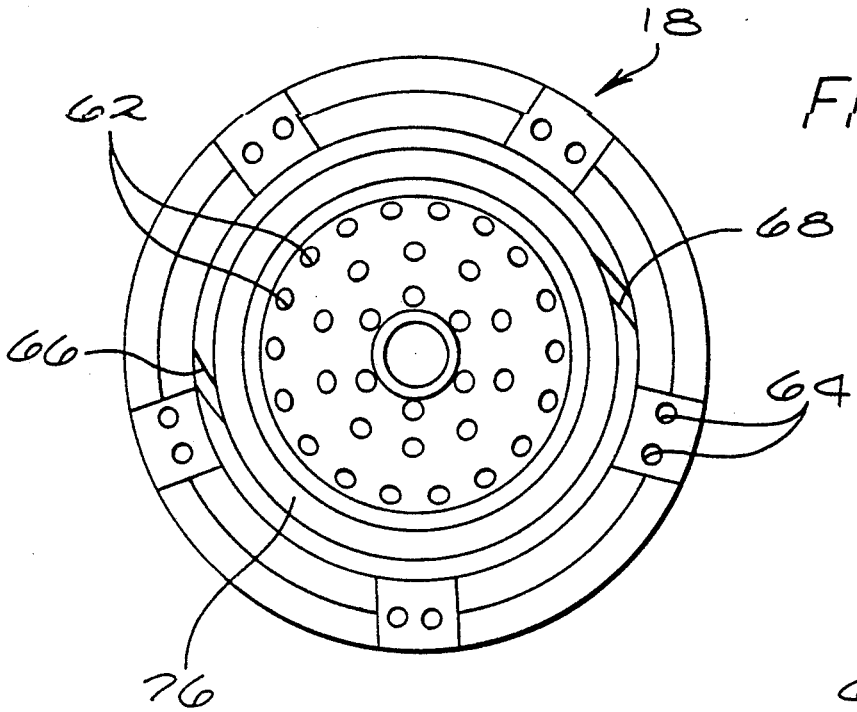
FIG. 8
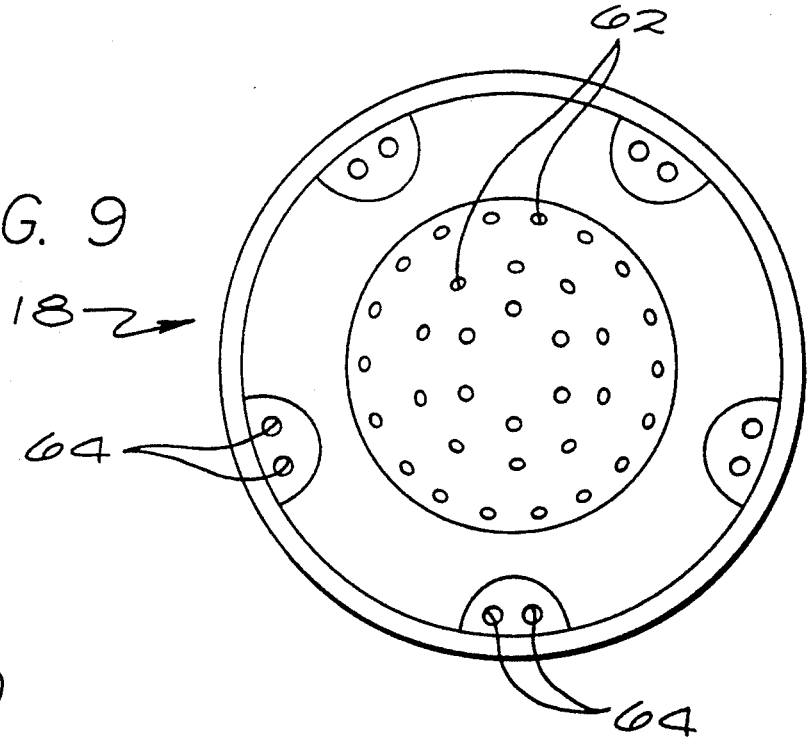
FIG. 9
FIG. 10
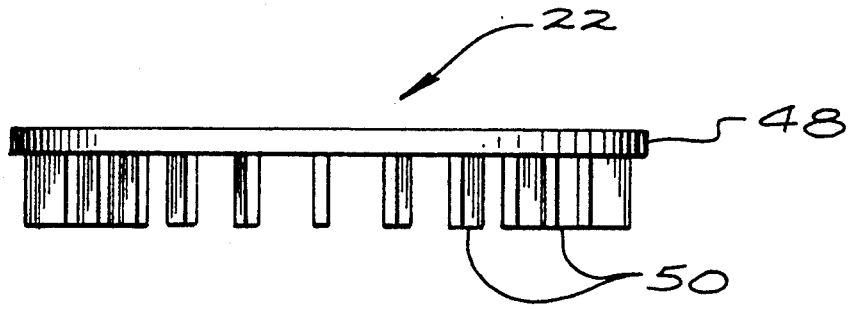

MULTI-FUNCTION SHOWER HEAD

This is a continuation of copending application Ser. No. 07/565,499, filed Aug. 10, 1990.

FIELD OF THE INVENTION

The present invention relates generally to valves and more particularly to valves used for shower head devices.

BACKGROUND OF THE INVENTION

Multi-function shower heads have been developed to provide the user with a selection of various types of effects such as a continuous spray, a pulsating jet or "message" effect, an aerated spray, and the like.

The designs of current multi-function shower heads are complex in terms of mechanisms used to select among the various types of sprays. Such mechanisms require, for example, multiple O-rings and valving mechanisms and gears that are difficult to fabricate and assemble. A typical example is shown in U.S. Pat. Nos. 3,672,648, 3,801,019, and 4,190,207, all of which reflect a design that has been widely sold. Furthermore, and as also reflected in the identified patents, many prior designs had difficult and complex mechanisms to convert the user's mechanical force into the required orientation and thus required various gearing and levers to orient the mechanical forces properly.

Accordingly, it is a primary object of the current invention to efficiently provide a shower head user with a variety of spray effects.

Another object of the invention is to reduce the complexity of a multi-function shower head.

A further object is to reduce the force required for the user to operate a shower head.

SUMMARY OF THE INVENTION

The present invention, in a broad aspect, is a shower head that provides a series of spray effects. The shower head includes an inlet port to establish fluid communication with a source of water and at least two outlet ports to direct a spray with various effects to the user. A pushrod disposed in fluid communication between the inlet port and the outlet ports selectively opens the outlet ports to allow the user to continuously select any combination of spray effects, which may include a continuous stream or a pulsating jet.

In accordance with one feature of the invention, the pushrod is actuated by a rotating cam ring operated by the user. The cam moves the pushrod transversely across the inlet port and, under control of the user, directs water from the inlet port to the outlet ports. The cam ring maintains the pushrod in the selected orientation.

In accordance with another feature of the invention, the inlet port includes a cavity having an upstream and a downstream opening, with the downstream opening being generally smaller in area than the upstream opening. The inlet port also provides a passageway in which is located the pushrod and it is through the passageway that fluid communication is established between the downstream opening and the outlet ports.

In accordance with yet another feature of the invention, the outlet ports include a series of outlet passages disposed in the valve body in fluid communication with the passageway such that the pushrod controllably directs water from the downstream opening in the inlet port through the passageway to one or more of the outlet passages. The outlet passages either direct water to bores that produce a constant spray, or angularly direct water against a rotor adjacent a series of openings to create a series of pulsating jets.

Other objects, features, and advantages of the present invention will become apparent from a consideration of the following detailed description and the accompanying drawings.

BRIEF DESCRIPTION OF THE DRAWINGS

FIG. 5 shows a cross-sectional view of the housing shown in FIG. 4, taken through the plane A—A;

FIG. 6 shows top view of the inlet housing shown in FIG. 4;

FIG. 7 shows a top view of the cam ring portion of the invention shown in FIG. 1;

FIG. 8 shows a plan view of the back side of the face plate portion of the invention shown in FIG. 1;

FIG. 9 shows an outward view of the face plate portion of the invention shown in FIG. 1; and FIG. 10 shows a side view of the rotor portion of the invention shown in FIG. 1.

DETAILED DESCRIPTION OF THE DRAWINGS

Figure 1:
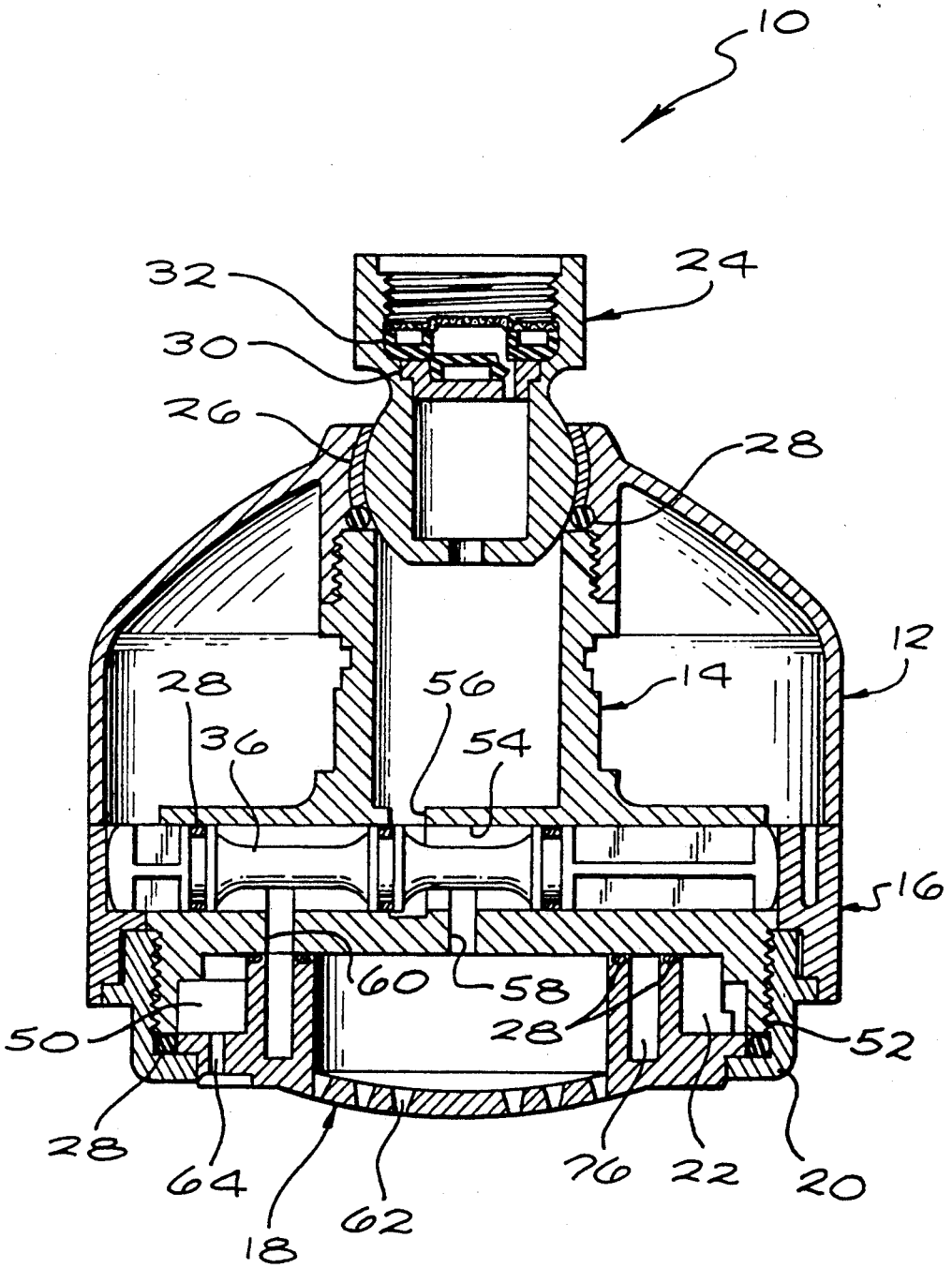
FIG. 1 shows a cross-sectional view of a shower head according to the present invention.
Figure 2:
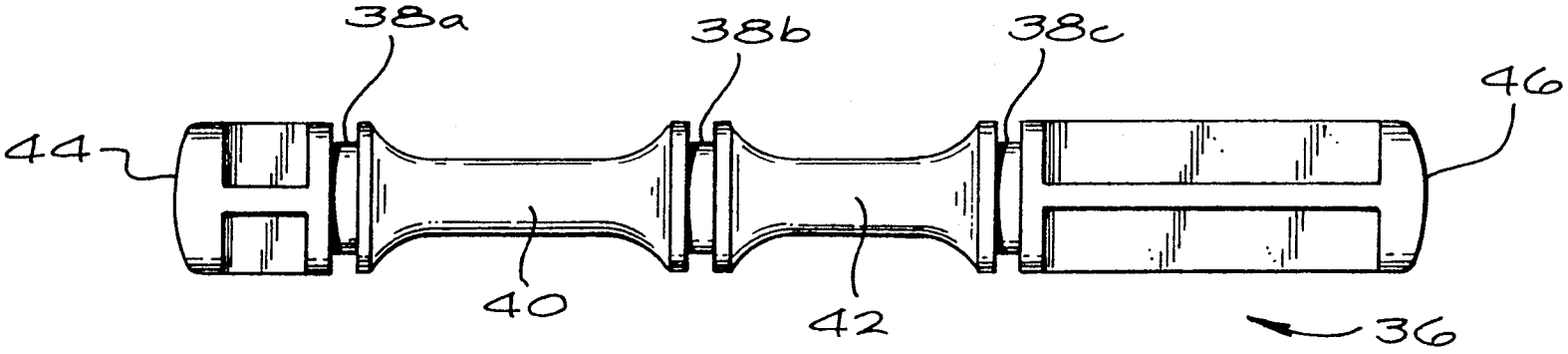
FIG. 2 shows a side view of the pushrod portion of the invention shown in FIG. 1.

Referring more particularly to the drawings, FIGS. 1–9 show the various parts of the present invention. Referring to FIG. 1, the shower head 10 according to the present invention includes an outer shell 12, that is threadingly engaged to a valve body 14. In the upper part of the shell is mounted a ball joint 24 maintained within the shell by a split ring 26 and sealed by an O-ring 28. Within the ball joint is located a flow control ring 30, a flow control restrictor 32 and a screen washer 34.

The valve body 14 has a generally cylindrical cavity forming an inlet port. The upper end of the cavity, relative to the orientation shown in FIG. 1, is of a large cross-sectional area and mates with the ball joint 24. Disposed at the lower end of the cavity is a downstream opening 56, which is of a smaller area. The downstream opening 56 functions as the inlet port relative to the outlet ports to be described herein. The inlet port is shown more fully in FIG. 6, which is a top view of the valve body 14.

Figure 4:
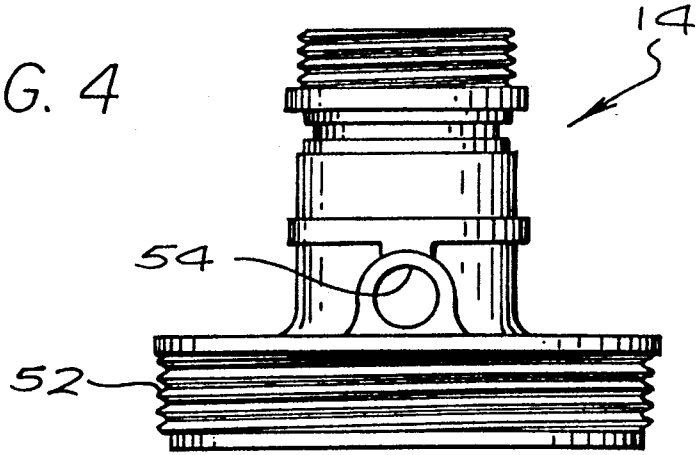
FIG. 4 shows a side view of the inlet port housing of the invention shown in FIG. 1.
Figure 3:
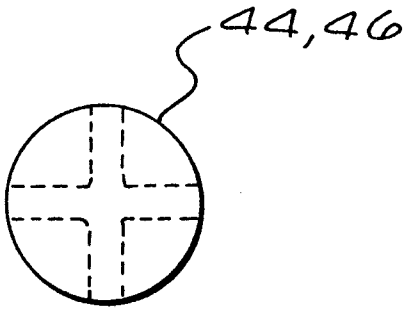
FIG. 3 shows an end view of the pushrod shown in FIG. 2.

The downstream opening 56 communicates with a passageway 54, which is also shown in cross-section in FIG. 6, as well as end-wise in FIG. 4. The passageway has at least two outlet ports 58 and 60, as shown in FIGS. 1 and 5. For purposes of this discussion, the ports 58 and 60 will be respectively referred to as a first outlet port (58) and a second outlet port (60). The first outlet port 58 communicates with the face plate 18 of the shower head. The face plate 18 is retained against the valve body 14 by a retainer ring 20 which, via threads 52, engages the valve body. A series of O-rings 28 mounted at various locations around the retainer ring and the face maintain sealing engagement between the parts.

The face plate 28 has two portions. The first portion, as shown most clearly in FIGS. 8 and 9, consists of a series of angled bores 62 which communicate with the first opening 58. These bores produced a constant spray. The second portion of the face plate 28 consists of a series of bores 64 grouped pair-wise around the periphery of the face plate, as shown in FIGS. 8 and 9. These holes receive water through two channels, 66 and 68, which communicate with an annular cavity 76, in the rear side of the face plate, as shown in FIGS. 1 and 8. This annular cavity 76 is in fluid communication with the second outlet port 60. Disposed between the face plate 28 and the valve body 14 is a rotor 22, which is shown in more detail in FIG. 10. The rotor has a rotor base 48 with a series of blades 50 spaced about the periphery. The rotor is oriented such that water from the channels 66 and 68 tangentially impacts the rotor blades 50, thereby imparting rotation. The spinning rotor thus breaks the flow of water from the annular cavity 76 to the outlet bores 64, thereby producing a pulsating effect.

Operation of the present invention is controlled by a pushrod 36 disposed within the passageway 54 in the valve body 14. The pushrod 36 is an elongated member having left and right cam following surfaces 44, 46. In the middle portion of the pushrod are two areas of reduced diameter 40 and 42 to allow the flow of water. Also located on the pushrod 36 are a series of O-ring channels 38*a*, *b*, and *c* which have mounted thereupon another series of O-rings 28. The left O-ring channel 38*a* and the right O-ring channel 38 are used to establish a fluid seal for the pushrod within the passageway 54. The central O-ring cavity 38*b* with the accompanying O-ring communicates with the downstream inlet port 56 to direct water from the inlet port 56 through the first and second outlet ports 58 and 60 as controlled by the user. When the pushrod is in the orientation shown in FIG. 1, all of the water flows from the downstream inlet 56 to the first outlet 58 and thereafter through the series of angled bores 62 to produce a continuous spray effect. Conversely, if the pushrod 36 is moved to the right side of the downstream opening 56, the first outlet passage 58 would be sealed and the second outlet passage 60 would be open, thereby producing the pulsating "jet" effect described hereinabove.

Alternatively, there can be a mixture of water flowing between the first and second outlet ports 58 and 60 if the middle O-ring channel 38*b* of the pushrod 36 was orientated somewhere between the full left position as shown in FIG. 1 and the full right position as described.

Control of the location of the pushrod is done by a cam ring 16 which is shown in more detail in FIG. 7. Cam ring 16 is mounted in the shower head by the retainer ring 20. It is free to rotate under control of the user. As shown in FIG. 7, the cam ring 16 has a series of outer teeth 74 which are used by the user to turn the cam ring. Disposed within the cam ring 16 are two cam surfaces 70 and 72 which engage the left and right cam follower surfaces 44 and 46 on the pushrod 36.

As can be seen, the present invention represents a much simpler valve mechanism that requires few parts and yet which can be made to perform all the necessary functions for providing various spray effects. It also requires much fewer parts to orient the user's force in the manner necessary for proper operation.

In the foregoing description of the present invention, a preferred embodiment of the invention has been disclosed. It is to be understood that other mechanical and design variations are within the scope of the present invention. For example, the present invention could be easily adapted for a hand-held shower head. Furthermore, a series of pushrods or a pushrod with additional flow control surfaces could be used to provide a series of different spray effects. Accordingly, the present invention is not limited to the particular arrangement which has been illustrated and described herein.

What is claimed is:

1. A shower head providing a plurality of spray effects, comprising:

inlet port means for establishing fluid communication with a source of water;

first outlet port means for directing a spray of water with a first spray effect to a user of said shower head;

second outlet port means for directing a spray of water with a second spray effect to said user; and pushrod means internally contained in said shower head and oriented generally perpendicular to the flow of water from said inlet port means, said pushrod means, disposed between said inlet port means and said first and second outlet port means, for selectively opening by rotary movement said first and second outlet port means to establish fluid communication with said inlet port means; and cam means, controlled by said user, for positioning said pushrod means to selectively open said first and said second outlet port means, whereby user can continuously select any combination of said first and second effects.

2. A shower head as defined in claim 1, wherein said shower head further comprises:

a cam surface mounted for arcuate movement about said inlet port means and contacting said pushrod means; and a cam follower mounted on said pushrod means and contacting said cam surface, whereby rotation of said cam means causes transverse movement of said pushrod means as determined by said cam surface.

3. A shower head as defined in claim 1, wherein said inlet port means comprises:

a surface defining a cavity, said cavity having an upstream opening for receiving water from said source and also having a downstream opening generally smaller in area than said upstream opening; and passageway means, supporting said pushrod means, for providing fluid communication between said downstream opening and said first and second outlet port means under the control of said pushrod means.

4. A shower head as defined in claim 3, wherein each of said first and second outlet port means comprises:

a series of outlet passages in fluid communication with said passageway means, whereby said pushrod means controllably directs water from said downstream opening in said inlet port means through said passageway means, to one or more of said outlet passages; and a plurality of spray means, each of said spray means corresponding to one of said outlet passages, for generating said plurality of spray effects, each of said spray means being in fluid communication with one of said outlet passages.

5. A shower head as defined in claim 3, wherein said pushrod means comprises:

an enlongated member moveable transversely, through said passageway means, said member including valve sealing means, selectively moveable across said downstream opening, for selectively opening portions of said passageway means to allow communication between said downstream opening and said outlet port means.

6. A shower head as defined in claim 2, wherein said cam means further comprises:

means disposed on the outer surface of said shower head for receiving operative control from said user and translating said operative control to said cam surface.

7. A shower head as defined in claim 4 wherein said plurality of spray means comprises:

first spray means for providing a continuous spray; and second spray means for providing a pulsating spray from said shower head.

8. A shower head as defined in claim 7 wherein said first spray means comprises a face plate in fluid communication with one of said outlet passages, said face plate defining a series of angled bores in constant fluid communication with said one of said outlet passages.

9. A shower head a defined in claim 7 wherein said second spray means comprises:

a face plate defining a series of discharge passages;

rotor means, disposed in said shower head for rotation adjacent said discharge passages, for interrupting the flow of water through each of said passages; and channel means, in fluid communication with said discharge passages and one of said outlet passages, for providing a tangential stream of water against said rotor to impart rotation to said rotor and to supply water to said discharge passages.

10. A method for generating a plurality of spray effects in a multi-function shower head having an inlet port and at least two outlet ports, with each of said ports providing a different spray effect, comprising:

directing water through said inlet port;

transversely moving a valve control rod which is completely enclosed within said shower head across said inlet port to selectively direct the flow of said water to one or more of said outlet ports; and controlling said transverse movement of said valve control rod with a cam surface operated by the user of said shower head.

* * * * *